US005345787A

United States Patent [19]

Piltingsrud

[11] Patent Number: 5,345,787

[45] Date of Patent: Sep. 13, 1994

[54] MINIATURE CRYOSORPTION VACUUM PUMP

[75] Inventor: Harley V. Piltingsrud, Cincinnati, Ohio

[73] Assignee: The United States of America as represented by the Department of Health and Human Services, Washington, D.C.

[21] Appl. No.: 128,731

[22] Filed: Sep. 30, 1993

Related U.S. Application Data

[63] Continuation of Ser. No. 762,531, Sep. 19, 1991, abandoned.

[51] Int. Cl.[5] ..... B01D 8/00

[52] U.S. Cl. ..... 62/55.5

[58] Field of Search ..... 62/55.5

[56] References Cited

U.S. PATENT DOCUMENTS

| | | | |
|---|---|---|---|
| 3,335,550 | 8/1967 | Stern . | |
| 3,625,019 | 12/1971 | Osterstrom | 62/55.5 |
| 3,721,101 | 3/1973 | Sheppard et al. | 62/55.5 X |
| 4,089,185 | 5/1978 | Kemmer et al. | 62/55.5 |
| 4,150,549 | 4/1979 | Longsworth . | |
| 4,227,951 | 7/1981 | Longsworth . | |
| 4,485,631 | 12/1984 | Winkler | 62/55.5 |
| 4,514,204 | 4/1985 | Bonney et al. | 62/55.5 X |
| 4,614,093 | 9/1986 | Bachler et al. | 62/55.5 |
| 4,655,046 | 4/1987 | Eacobacci et al. . | |
| 4,691,534 | 9/1987 | Lombardini et al. . | |
| 4,757,689 | 7/1988 | Bachler et al. . | |
| 4,763,483 | 8/1988 | Olsen . | |
| 4,785,666 | 11/1988 | Berquist | 62/55.5 X |
| 4,815,303 | 9/1989 | Duza . | |
| 4,833,899 | 5/1989 | Tugal | 62/55.5 |
| 4,862,697 | 9/1989 | Tugal et al. . | |
| 4,896,511 | 1/1990 | Lessard et al. | 62/55.5 |
| 4,910,965 | 3/1990 | Lepofsky et al. | 62/55.5 |
| 4,918,930 | 4/1990 | Gaudet et al. . | |
| 4,966,016 | 10/1990 | Bartlett | 62/55.5 |

*Primary Examiner*—John C. Fox
*Attorney, Agent, or Firm*—Lowe, Price, LeBlanc & Becker

[57] ABSTRACT

A miniature cryosorption vacuum pump capable of producing intermediate vacuums on the order of about $10^{-2}$ to $10^{-4}$ torr is provided which includes a closed cycle Stirling cycle refrigerator. The overall weight of the miniature cryosorption vacuum pump (including the refrigerator) is less than about 2.5 kg, making the miniature cryosorption vacuum pump particularly suitable for portable or field use. The miniature cryosorption vacuum pump may be used as a roughing pump in various applications which require intermediate vacuum rough pumping or as a high vacuum pump where low pumping rates are required at pressures down to $5\times10^{-5}$ torr.

38 Claims, 3 Drawing Sheets

MINIATURE CRYOSORPTION VACUUM PUMP

This application is a continuation of application Ser. No. 07/762,531, filed Sep. 19, 1991, abandoned.

TECHNICAL FIELD

The present invention relates to cryosorption vacuum pumps. More particularly, the present invention relates to miniature cryosorption vacuum pumps which produce intermediate pressures.

BACKGROUND ART

Cryosorption pumps, whether cooled by open or closed cryogenic cycles, generally follow the same design concept. A low temperature array, usually operating in the range of 4° to 25° K, is the primary pumping surface. This surface is surrounded by a higher temperature radiation shield, usually operated in the temperature range of 70° to 130° K, which provides radiation shielding to the lower temperature array. The radiation shield generally includes a housing which is closed except at a frontal array positioned between the primary pumping surface and the chamber to be evacuated. This higher temperature, first stage frontal array serves as a pumping site for higher boiling gases such as water vapor or carbon dioxide. Cryosorption pumps are conventionally quite bulky and cumbersome due to the refrigeration equipment necessary to produce the requisite cryogenic cooling.

Heretofore, mechanical rotary vane and piston type pumps capable of producing intermediate pressures (0.01 to 10 torr) have been used as backing pumps for oil diffusion and turbomolecular pumps as well as roughing pumps for starting ion pumps and cryogenic pumps. These pumps are generally quite heavy, bulky and usually produce oil vapors which can contaminate a vacuum system. Such pumps also are quite energy inefficient.

Molecular sieve materials have been used to both produce high vacuums when cooled to very low temperatures (less than 20° K) and have been used in intermediate vacuum applications (when cooled to approximately 70° K, or at room temperature under special conditions).

Previous use of molecular sieve materials for intermediate pressure sorption pumping have relied on either the use of a replaceable cold material such as liquid nitrogen or a very bulky and heavy closed cycle refrigerator to cool the molecular sieve material down to the necessary pumping temperatures. The use of such molecular sieve materials for achieving intermediate pressure sorption pumping has generally been reserved for very clean vacuum roughing applications.

Portable instrumentation requiring the use of intermediate pressure vacuum pumping has generally relied upon the use of heavy and bulky mechanical pumps, due to the difficulty involved in obtaining liquid nitrogen for cryosorption pumps under field conditions, and also due to the size and weight of room temperature sorption pumps.

The present invention relates to a miniature cryosorption pump which is an improvement over prior art cryosorption pumps.

DISCLOSURE OF THE INVENTION

It is accordingly one object of the present invention to provide a miniature cryosorption vacuum pump.

Another object of the present invention is to provide for a light-weight miniature cryosorption vacuum pump.

A further object of the present invention is to provide for a cryosorption vacuum pump which weighs less than about 2.5 kg.

An even further object of the present invention is to provide for a miniature cryosorption vacuum pump which is energy efficient.

A still further object of the present invention is to provide for a miniature cryosorption pump which is capable of producing intermediate vacuums for various applications.

According to these and further objects of the present invention which will become apparent as the description thereof is presented below, the present invention provides a miniature cryosorption vacuum pump comprising a cold finger having first and second ends, an adsorbent material surrounding one of the first and second ends of the cold finger, and a closed cycle Stirling cycle refrigerator connected to the other of the first and second ends of the cold finger, for lowering the temperature of the cold finger.

The present invention also provides for use of the miniature cryosorption pump in conjunction with a mechanical pump which is connected to the miniature cryosorption pump for applying a vacuum to the miniature cryosorption pump during the regeneration of the adsorbent material contained therein.

The present invention further provides for use of the miniature cryosorption pump in conjunction with a high vacuum pump and a separate vacuum chamber wherein the miniature cryosorption vacuum pump is connected to the high vacuum pump for pumping the high vacuum pump to an intermediate vacuum, and the high vacuum pump is connected to the separate vacuum chamber for pumping the chamber to a vacuum which is lower than the intermediate vacuum.

BRIEF DESCRIPTION OF DRAWINGS

The present invention will be described with reference to the annexed drawings which are given by way of a non-limiting examples only in which.

BEST MODE FOR CARRYING OUT THE INVENTION

The present invention relates to a miniature cryosorption pump which is designed to be light weight so as to be particularly suitable for field use. In this regard, the miniature cryosorption pump of the present invention allows field use of equipment which requires intermediate vacuums on the order of about $10^{-2}$ to $5\times10^{-5}$ torr, including instruments which require vacuum chambers. Alternatively, the miniature cryosorption pump of the present invention may be utilized to provide supplemental intermediate or backing vacuums for systems such as mass spectrometers and the like which may require higher vacuums than can be achieved with the miniature cryosorption pump alone.

Although designed to provide intermediate vacuums for field use, the miniature cryosorption pump of the present invention may also be used in laboratory and industrial settings in conjunction with testing, measurement and monitoring procedures and equipment, and in production procedures and equipment such as those utilized in the manufacturing of semiconductor devices which require intermediate and high vacuums, e. g, thin film sputtering, etching, etc.

The miniaturization of the cryosorption vacuum pump according to the present invention involves the use of a closed cycle Stirling cycle refrigerator, e.g. , single stage helium Stirling cycle refrigerator, which provides for an extremely efficient means for operating the cold finger of the cryosorption pump of the present invention. The closed cycle Stirling cycle refrigerator is preferably selected so as to weigh less than 2 kg. The other components of the cryosorption pump can be limited to a total weight of 0.5 kg or less. Thus, the total weight of the entire system can be limited to 2.5 kg or less, making the system portable.

The cryosorption pump of the present invention may utilize any conventional adsorbent material such as silica gel, charcoal, zeolite, or the like. A particularly preferred adsorbent material for purposes of the present invention is a molecular sieve material such as activated type 5A molecular sieve. The adsorbent material surrounds a cold finger as described below and is used in a known manner to adsorb gases. After a pumping operation, the adsorbent material is regenerated by heating the adsorbent material to a suitable temperature, e.g. greater than 90° C. The required heat may be supplied by an electrical resistance heater or by reversing the refrigeration cycle as discussed in detail below. According to one embodiment of the present invention, the adsorbent material is contained in a module which is movable relative to the cold finger. In this embodiment, the adsorbent may be moved away from the cold finger during regeneration of the adsorbent material, to allow for regeneration temperatures higher than the cold finger could withstand.

Figure 1:
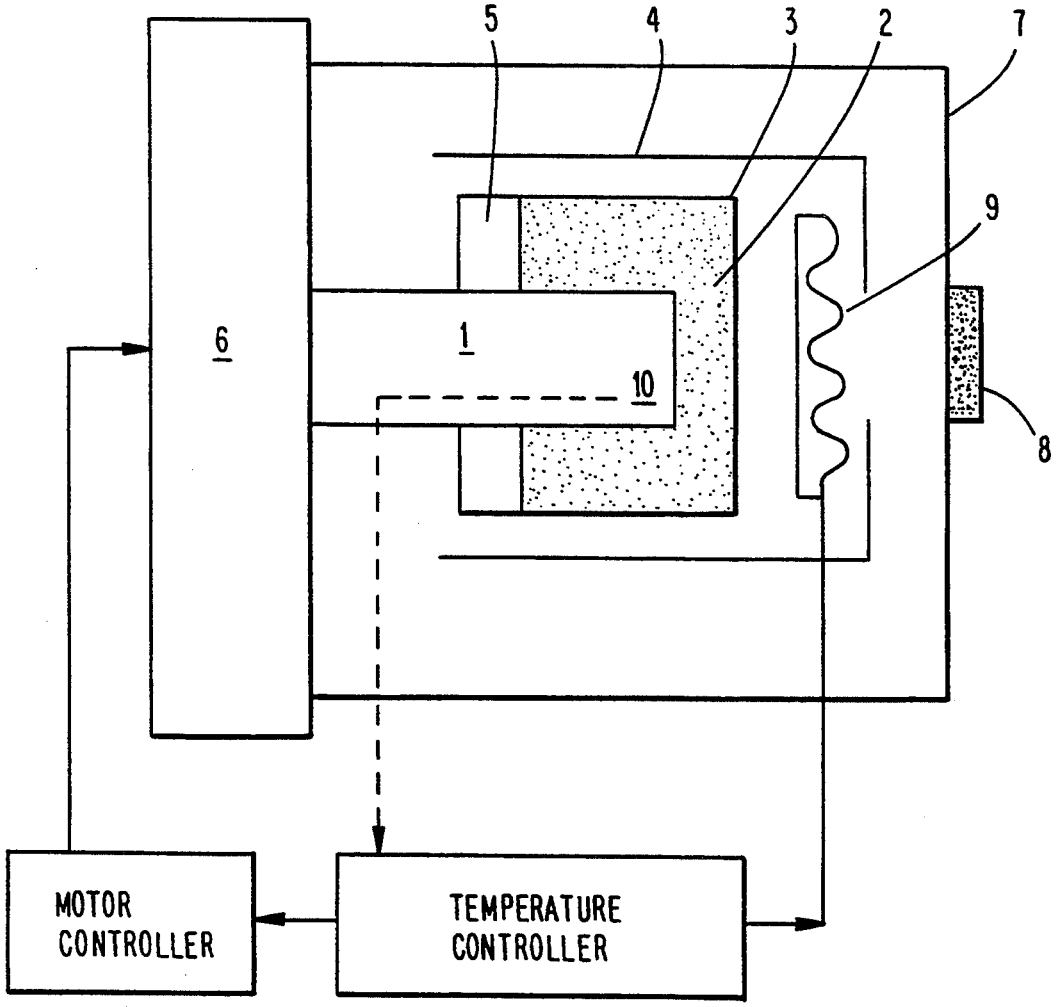
FIG. 1 is a schematic diagram illustrating the elements of a miniature cryosorption pump according to one embodiment of the present invention.

FIG. 1 is a schematic diagram illustrating the elements of a miniature cryosorption pump according to the present invention. As illustrated in FIG. 1, the cryosorption pump includes a cold finger 1 which is surrounded by an adsorbent material such as a molecular sieve material 2, e.g, commercial grade activated type 5A. The molecular sieve material 2 which surrounds cold finger 1 is contained in a porous reflective housing 3, e.g, silver plated copper screen, which in turn is surrounded by a reflective heat shield, e.g., aluminum foil, and convection restrictor 4 and insulation material 5. The reflective heat shield and convection restrictor 4 is enclosed in a vacuum chamber 7 having an inlet 8, which is connectable to a system to which a vacuum is to be applied or, alternatively, to a pump for regenerating the molecular sieve material 2.

By insulating the cold finger 1 from it's surroundings with the molecular sieve material 2, porous reflective housing 3, reflective heat shield and convection restrictor 4, and insulation layer 5, chilling of the molecular sieve material 2 provides for an initial rough pumping of the vacuum system down to the point where convection transport of heat energy to the cold assembly which includes cold finger 1, molecular sieve material 2, porous reflecting housing 3, reflective heat shield and convection restrictor 4, and insulation layer 5 is low enough to allow for a complete cooling of the cold assembly. For pumping from intermediate pressures, e.g., 20–30 torr, the convection restrictor 4 may be eliminated due to the much lower heat transfer rate from convection.

According to the present invention, cold finger 1 is cooled by a closed cycle Stirling cycle refrigerator, e.g., single stage helium Stirling cycle refrigerator 6. Preferably, the refrigerator 6 utilized is selected to be as light weight as possible and to utilize as little energy as possible so as to be useful for field operation. Present commercially available refrigerators which are particularly suitable for use in the present invention including those having a 1 W capacity at 70° K, weigh between about 1.6 and 2.0 kg, and consume as little as 45 W of electrical power (Model 7022H, the Hughes Aircraft Co.) In order to limit the overall weight and size of the cryosorption pump of the present invention, the components of the system other than the refrigerator are preferably selected to have a combined weight of less than 0.5 kg. The refrigerated components are located in a vacuum tight container 7. In a further embodiment of the present invention, a thermoelectric(Peltier) cooler to cool the cold finger. The use of a thermoelectric(Peltier) cooler provides a lower cost pump which can produce acceptable vacuums with a decrease in pumping capacity and efficiency as compared to the use of a Stirling cycle refrigerator.

For more efficient operation when utilizing the miniature cryosorption vacuum pump of the present invention in a typical procedure, e.g., in conjunction with a portable mass spectrometer, gas loading of the molecular sieve material can be reduced by pumping from atmospheric pressure to an intermediate pressure (such as 20 torr) using a suitable mechanical pump, e.g., a diaphragm mechanical pump. For field use, a miniature mechanical pump is particularly preferred so as to keep the weight and size of the assembly to a minimum. In this regard, the present inventors preferably use a miniature vacuum pump which is made from commercially available components. As an example, the inventors preferably use a miniature diaphragm vacuum pump having pumping speeds of approximately 10 torr-L $min^{-1}$ at 30 torr (Brailsford & Co., Nye, N.Y., model TD4X2, 4 pump heads in series, and with a 4.5 mm stroke).

A suitable mechanical pump, e.g., a diaphragm pump, can is used to facilitate regeneration of the molecular sieve material in a known manner. In a preferred embodiment, the pump utilized to reduce gas loading of the molecular sieve material by pumping from atmospheric pressure to an intermediate pressure is also utilized to aid the regeneration of the molecular sieve material. The regeneration of the molecular sieve material can be accomplished by heating the sieve material to >90° C. for a suitable period of time while pumping to an intermediate pressure (approximately 20 torr) to effect a desired degree of regeneration. This is normally done while the high vacuum chamber or outlet of a high vacuum pump is isolated by a valve from the cryosorption pump. In a preferred embodiment, regeneration was accomplished by heating the sieve material to about 300° C. for approximately 5 minutes.

The heat required for regenerating the molecular sieve material may be applied from any suitable heating means including electrical resistance heating elements. In embodiments, found to particularly advantageous, the necessary heat required to regenerate the molecular sieve material was provided by the reversal of the refrigeration cycle by operating the illustrated motor controller so as to reverse the compressor motor rotation, or by the use of one or more electrical resistance heaters 9 imbedded in the molecular sieve and/or in the cold finger 1 itself, or by radiant heating of the sieve material from a distance of several millimeters from the cold finger.

In one particularly preferred embodiment of the present invention, the use of radiant heating was determined to provide two particular advantages. First, the elimination of thermal contact to the cold finger from electrical leads would reduce heat leakage to the cold finger. Second, radiant heating would provide more heating to the exterior molecular sieve material allowing molecular sieve material to reach a higher temperature while still maintaining acceptable temperature limits for the cold finger. In this regard, the miniature cryosorption pump provided according to one embodiment of the present invention had a cold finger upper temperature limit of 90° C. due to the use of plastic parts in the cold finger. In other embodiments, the cold finger could be constructed with metal parts, allowing much higher temperature operation and thus making the assembly particularly suitable for the reversed cycle operation.

Regardless what material is used to make the cold finger, in order to prevent subjecting the cold finger to excessive temperatures, the temperature of the cold finger is limited to some upper limit by sensing its temperature with thermocouple 10, which either regulates the compressor motor of the refrigeration cycle by means of the motor controller or the power applied to the electrical heaters by means of the temperature controller.

Figure 2:
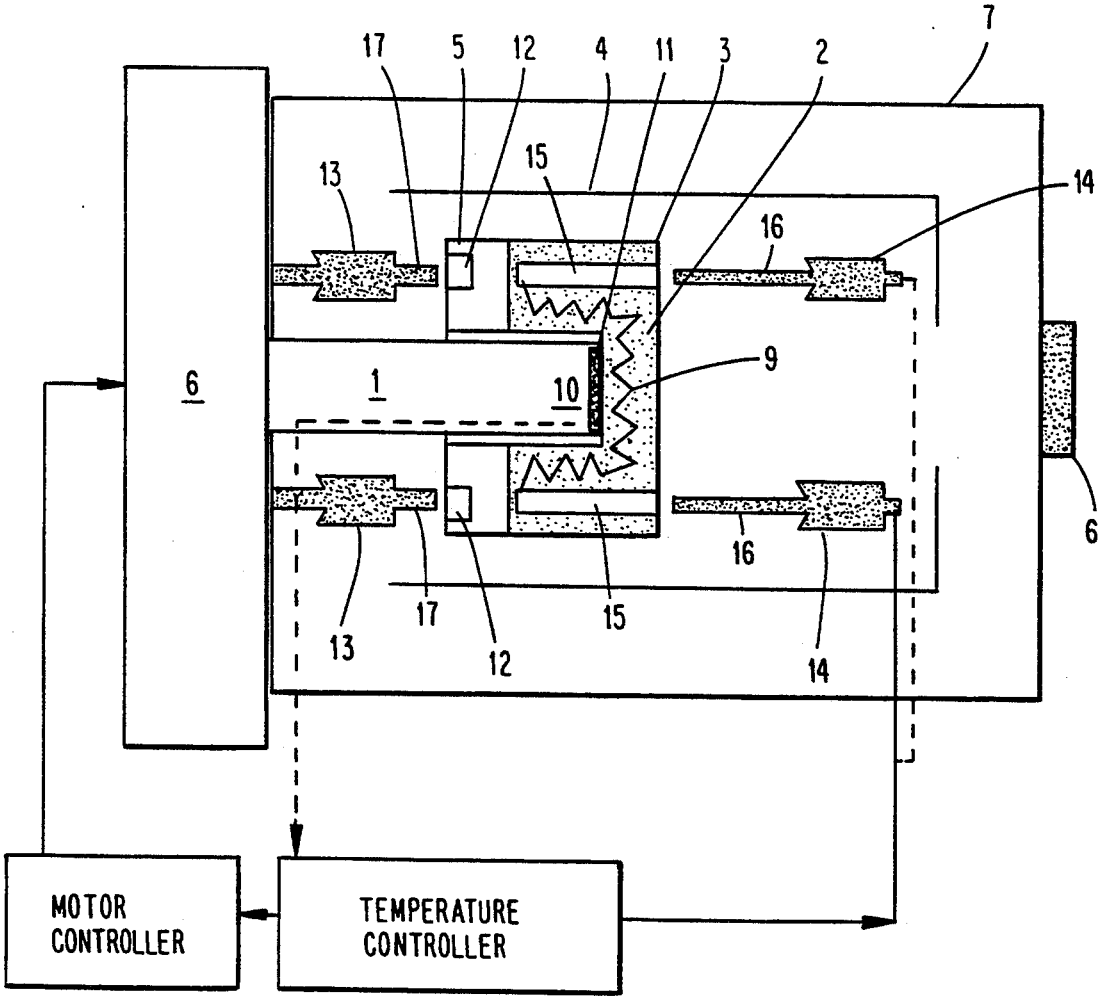
FIG. 2 is a schematic diagram illustrating the elements of a miniature cryosorption pump according to another embodiment of the present invention.

FIG. 2 is a schematic diagram illustrating the elements of a miniature cryosorption pump according to another embodiment of the present invention. Elements shown in FIG. 2 which are con, non to those shown in FIG. 1 are identified by similar reference numerals. The embodiment of the invention shown in FIG. 2 represents an alternative approach to regeneration in which the molecular sieve material 2 is contained in a module which can be moved away from the cold finger 1 during regeneration of the molecular sieve material 2. This allows for the use of a much higher and more homogeneous temperature during regeneration.

In FIG. 2, the molecular sieve material 2 is contained in a molecular sieve module which comprises a porous reflective housing 3, an insulation layer 5, a resistance heater 9, thermal contact material 11, and permanent magnets 12, as depicted. During an operation other than regeneration, e.g., a pumping operation, the molecular sieve module is positioned as shown in FIG. 2 so that the molecular sieve material 2 within the molecular sieve module surrounds the end of cold finger 1, and the porous reflective housing 3 is in thermal contact with cold finger 1 through thermal contact material 11 which can be attached to either the cold finger 1 of the porous reflective housing 3.

During a regeneration operation, electromagnets 13 are activated in a repulsive mode so as to repel permanent magnets 12. Simultaneously, electromagnets 14 are activated in an attractive mode so as to attract the molecular sieve module. The combined resulting repulsive and attractive forces acting on the molecular sieve module causes the molecular sieve module to move away form the cold finger 1. It is noted that each of the electromagnets 13 and 14 should have a Curie temperature which is grater than the regeneration temperature in order to ensure that sufficient magnetic forces can be provided to more the molecular sieve module.

As shown in FIG. 2, the resistance heater element 9 has electrical leads located int he bottoms of electrical contact wells 15 which are formed in the porous reflective housing 3. As the molecular sieve module is moved away from the cold finger 1 (towards the right as shown in FIG. 2) under the influence of the magnetic forces, electrical contacts 16, i.e., conducting poles, extending from electromagnets 14 are received in the electrical contact wells 15 to help guide the movement of the molecular sieve module. After the ends of the electrical contacts 16 contact the electrical leads of the resistance heater 9 in the bottoms of the electrical contact wells 15, an electrical potential controlled by the illustrated temperature controller can be applied to the resistance heater 9 to begin regeneration. Regeneration then proceeds with the resistance heater 9 raising the temperature of the molecular sieve module to an appropriate temperature to effect a desired degree of regeneration of the molecular sieve material 2.

After regeneration and cooling of the molecular sieve module to an acceptable temperature which will not harm the cold finger 1, electromagnets 14 are activated in a repulsive mode while electromagnets 13 are actuated in an attractive mode, causing the molecular sieve module to move back into thermal contact with the cold finger 1 as shown in FIG. 2.

When the molecular sieve module is positioned in thermal contact with the cold finger as shown in FIG. 2, the electromagnets 13 and 14 can be deactivated since the attraction force of the permanent magnets 12 to the iron pole pieces 17 of the electromagnets 13 is sufficient to retain the molecular sieve module in thermal contact with cold finger 1.

In order to ensure that the molecular sieve module is in thermal contact with the cold finger 1 when the molecular sieve module is positioned as shown in FIG. 2, a thermal contact material 11, e.g., copper wool, is provided between the molecular sieve module and the cold finger 1, as discussed above.

As an example of the type of capacity provided by the miniature cryosorption vacuum pump of the present invention, in one embodiment a miniature cryosorption vacuum pump using 10 g of type 5A molecular sieve was determined to be capable of pumping at rates greater than 10 torr-L $s^{-1}$, and at a capacity of greater than 1000 torr-L. In another example, a laboratory model using 1.7 g of type 5A sieve material was found to reduce the pressure in a 0.9 L container from 20 torr to $5\times10^{-5}$ torr in approximately 15 minutes. In this laboratory model, the pumping speed at $1\times10^{-4}$ torr was determined to be approximately 5 torr-L $s^{-1}$. As a comparison, the smallest commercial mechanical rotary vane vacuum pump weighs greater than 8 kg, consumes greater than 400 W of power, and pumps at a rate of less than 0.5 L/s, and a lower pressure limit of $10^{-3}$ torr.

In applications where the total mass of gas to be adsorbed over a given time interval is compatible with the capacities of the molecular sieve material in a given pump design, the miniature cryosorption vacuum pump according to the present invention will be lighter, more energy efficient, and provide a cleaner vacuum than comparable mechanical rotary vane or piston pumps. This characteristic feature makes the miniature cryosorption pumps of the present invention particularly advantageous in portable instruments and related systems.

Figure 3:
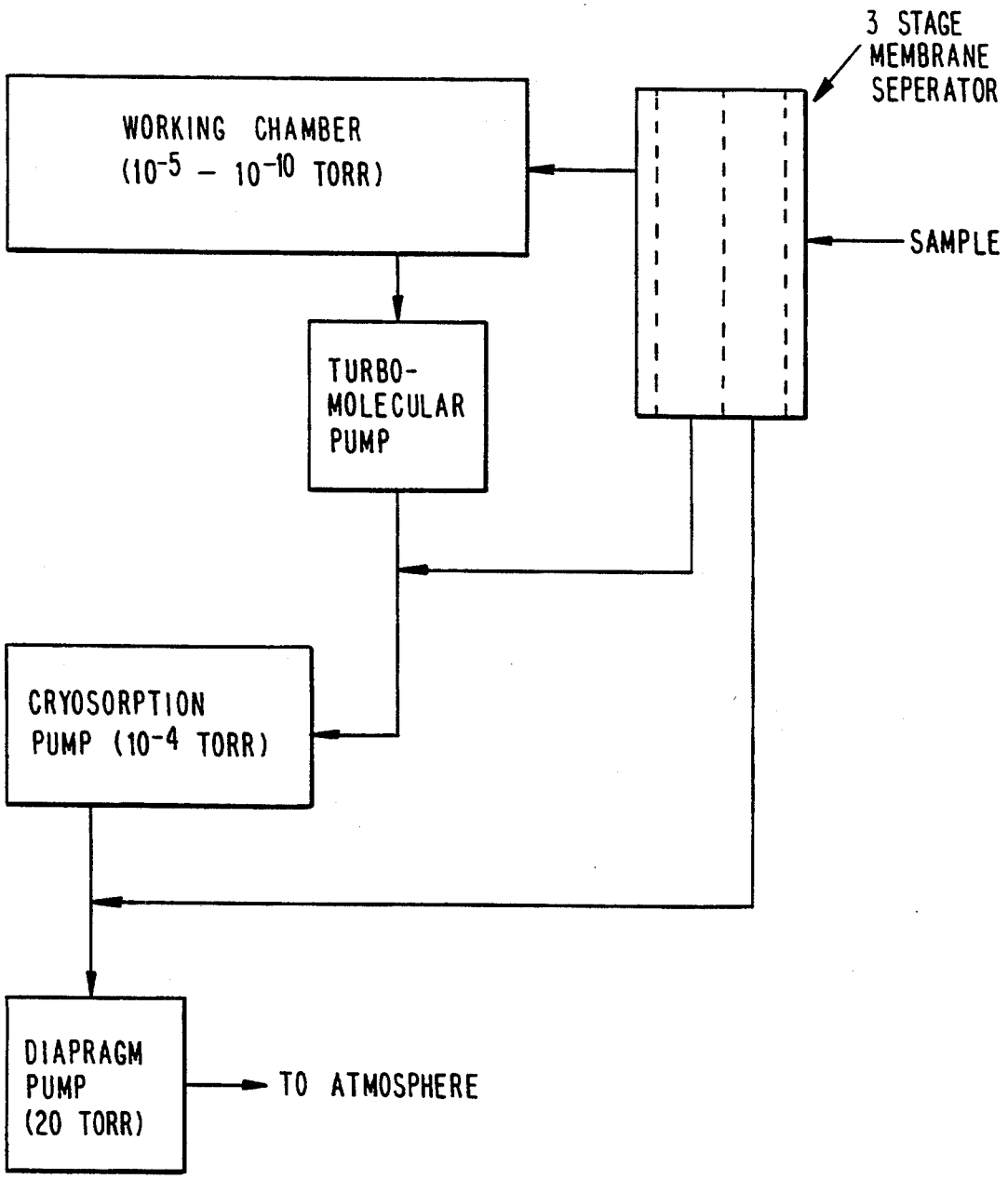
FIG. 3 is a schematic block diagram illustrating an application of a miniature cryosorption pump according to the present invention.

An example of a typical application of a miniature cryosorption vacuum pump is given in FIG. 3. The exemplary application is for a portable mass spectrometer, where the miniature cryosorption pump is used to provide the necessary intermediate pressure ($10^{-2}$ to $10^{-4}$ torr) backing for a high vacuum pump, i.e., a turbomolecular pump, which provides the necessary high vacuum of $<10^{-6}$ torr for the mass spectrometer. The cryosorption pump also provides a necessary intermediate pressure (10−2 to $10^{-4}$ torr) for the interstage (stage 2 to 3) of a three-stage membrane separator for the mass spectrometer inlet. Under some circumstances, the lower pressure limit (approximately $5\times10^{-5}$ torr) of the miniature cryosorption vacuum pump may be adequate for providing the high vacuum for a mass spectrometer (when lower pumping rates are required).

Although the invention has been described with reference to particular means, materials and embodiments, from the foregoing description, one skilled in the art can easily ascertain the essential characteristics of the present invention and various changes and modifications may be made to adapt the various uses and conditions without departing from the spirit and scope of the present invention as described by the claims which follow.

What is claimed is:

1. A miniature cryosorption vacuum pump comprising a cold finger having first and second ends, an adsorbent material surrounding one of said first and second ends of said cold finger, and a closed cycle Stirling cycle refrigerator connected to the other of said first and second ends of said cold finger, for lowering the temperature of said cold finger, said miniature cryosorption pump weighing no more than about 2.5 kg and having a lower operable temperature limit of about 70° K.

2. A miniature cryosorption vacuum pump according to claim 1, further comprising means for moving said adsorbent material relative to said cold finger.

3. A miniature cryosorption vacuum pump according to claim 1, wherein said closed cycle Stirling cycle refrigerator comprises a single stage helium Stirling cycle refrigerator.

4. A miniature cryosorption vacuum pump according to claim 1, wherein said adsorbent material comprises a molecular sieve material.

5. A miniature cryosorption vacuum pump according to claim 4, wherein said molecular sieve material comprises activated type 5A molecular sieve material.

6. A miniature cryosorption vacuum pump according to claim 1 further comprising means to heat said adsorbent material and means to apply a vacuum to said adsorbent material.

7. A miniature cryosorption vacuum pump according to claim 6, wherein said means to heat said adsorbent material comprises an electrical resistance heater.

8. A miniature cryosorption vacuum pump according to claim 6, wherein said means to heat said adsorbent material comprises means to reverse the cycle of said closed cycle Stirling cycle refrigerator.

9. A miniature cryosorption vacuum pump according to claim 6, wherein said means to heat said adsorbent material comprises a radiant heater means.

10. A miniature cryosorption vacuum pump according to claim 9, further comprising means to sense and control the temperature of said cold finger.

11. A miniature cryosorption vacuum pump comprising a cold finger having first and second ends, an adsorbent material surrounding one of said first and second ends of said cold finger, a closed cycle Stirling cycle refrigerator connected to the other of said first and second ends of said cold finger, for lowering the temperature of said cold finger and means for moving said adsorbent material relative to said cold finger, wherein said means for moving said adsorbent material comprises a module containing said adsorbent material and magnetic means for moving said module.

12. A miniature cryosorption vacuum pump according to claim 11, wherein said magnetic means comprises both permanent magnets and electromagnets.

13. A miniature cryosorption vacuum pump comprising a cold finger having first and second ends, an adsorbent material surrounding one of said first and second ends of said cold finger, and a closed cycle Stirling cycle refrigerator connected to the other of said first and second ends of said cold finger, for lowering the temperature of said cold finger in combination with a mechanical pump connected to said miniature cryosorption pump for applying a vacuum to said miniature cryosorption pump for regenerating said adsorbent material, said miniature cryosorption pump weighing no more than about 2.5 kg and having a lower operable temperature limit of about 70° K.

14. The combination set forth in claim 13, where in said mechanical pump comprises a diaphragm pump.

15. The combination set forth in claim 14, wherein said mechanical pump comprises a miniature diaphragm pump.

16. A miniature cryosorption vacuum pump comprising a cold finger having first and second ends, an adsorbent material surrounding one of said first and second ends of said cold finger, a closed cycle Stirling cycle refrigerator connected to the other of said first and second ends of said cold finger, for lowering the temperature of said cold finger in combination with a high vacuum pump and a separate vacuum chamber wherein said miniature cryosorption pump is connected to said high vacuum pump for pumping sad high vacuum pump to an intermediate vacuum, and said high vacuum pump is connected to said separate vacuum chamber for pumping said chamber to a vacuum which is higher than said intermediate vacuum, said miniature cryosorption pump weighing no more than about 2.5 kg and having a lower operable temperature limit of about 70° K.

17. The combination of claim 16, wherein said high vacuum pump comprises an oil diffusion pump.

18. The combination of claim 16, wherein said high vacuum pump comprises a turbomolecular pump.

19. The combination of claim 16, wherein said separate vacuum chamber comprises the working chamber of a mass spectrometer.

20. The combination of claim 19, wherein said mass spectrometer comprises a portable mass spectrometer.

21. A miniature cryosorption vacuum pump comprising a single stage cold finger having first and second ends, an adsorbent material surrounding one of said first and second ends of said single stage cold finger, and a closed cycle Stirling cycle refrigerator connected to the other of said first and second ends of said single stage cold finger, for lowering the temperature of said single stage cold finger.

22. A miniature cryosorption vacuum pump according to claim 21, further comprising means for moving said adsorbent material relative to said single stage cold finger.

23. A miniature cryosorption vacuum pump according to claim 21, wherein said closed cycle Stirling cycle refrigerator comprises a single stage helium Stirling cycle refrigerator.

24. A miniature cryosorption vacuum pump according to claim 21, wherein said adsorbent material comprises a molecular sieve material.

25. A miniature cryosorption vacuum pump according to claim 24, wherein said molecular sieve material comprises activated type 5A molecular sieve material.

26. A miniature cryosorption vacuum pump according to claim 21, further comprising means to heat said adsorbent material.

27. A miniature cryosorption vacuum pump according to claim 26, wherein said means to heat said adsorbent material comprises an electrical resistance heater.

28. A miniature cryosorption vacuum pump according to claim 26, wherein said means to heat said adsorbent material comprises means to reverse the cycle of said closed cycle Stirling cycle refrigerator.

29. A miniature cryosorption vacuum pump according to claim 26, wherein said means to heat said adsorbent material comprises a radiant heater means.

30. A miniature cryosorption vacuum pump according to claim 29, further comprising means to sense and control the temperature of said single stage cold finger.

31. A miniature cryosorption vacuum pump comprising a single stage cold finger having first and second ends, an adsorbent material surrounding one of said first and second ends of said single stage cold finger, and a closed cycle Stirling cycle refrigerator connected to the other of said first and second ends of said single stage cold finger, for lowering the temperature of said single stage cold finger in combination with a mechanical pump connected to said miniature cryosorption pump for applying a vacuum to said miniature cryosorption pump for aiding regenerating said adsorbent material.

32. The combination set forth in claim 31, wherein said mechanical pump comprises a diaphragm pump.

33. The combination set forth in claim 32, wherein said mechanical pump comprises a miniature diaphragm pump.

34. A miniature cryosorption pump vacuum pump comprising a single stage cold finger having first and second ends, an adsorbent material surrounding one of said first and second ends of said single stage cold finger, and a closed cycle Stirling cycle refrigerator connected to the other of said first and second ends of said single stage cold finger, for lowering the temperature of said single stage cold finger in combination with a high vacuum pump and a separate vacuum chamber wherein said miniature cryosorption vacuum pump is connected to said high vacuum pump for pumping said high vacuum pump to an intermediate vacuum, and said turbomolecular pump is connected to said separate vacuum chamber for pumping said chamber to a vacuum which is higher than said intermediate vacuum.

35. The combination of claim 34, wherein said high vacuum pump comprises an oil diffusion pump.

36. The combination of claim 34, wherein said high vacuum pump comprises a turbomolecular pump.

37. The combination of claim 34, wherein said separate vacuum chamber comprises the working chamber of a mass spectrometer.

38. The combination of claim 37, wherein said mass spectrometer comprises a portable mass spectrometer.

* * * * *